United States Patent [19]

Lars

[11] Patent Number: 4,657,789

[45] Date of Patent: Apr. 14, 1987

[54] METHOD FOR THE PRODUCTION OF A VENEER

[76] Inventor: Nilsson Lars, Richters Gata 4A, S-541 31 Skovoe, Sweden

[21] Appl. No.: 787,683

[22] Filed: Oct. 15, 1985

[51] Int. Cl.[4] ..... B05D 1/18; B05D 1/28; B05D 3/02

[52] U.S. Cl. ..... 427/372.2; 427/440; 427/377; 427/428; 428/541

[58] Field of Search ..... 427/4, 440, 377, 372.2, 427/428; 428/541

[56] References Cited

U.S. PATENT DOCUMENTS 3,076,738 2/1963 Uschmann ..... 427/440 X 3,950,577 4/1976 Fry ..... 427/440 X

*Primary Examiner*—Michael R. Lusignan

*Attorney, Agent, or Firm*—Balogh, Osann, Kramer, Dvorak, Genova & Traub

[57] ABSTRACT

The invention relates to a method for the production of a wood veneer resistant to, amongst other things, micro-organisms and insects which is suitable for use in constructions intended for joinery, construction, packaging and installation applications.

In accordance with one rational embodiment of the invention raw veneer is impregnated before it has dried, whereupon it is dried by heating. The impregnation medium is incorporated in this way after diffusion of the ring pores of the veneer once its cell walls have been sealed.

11 Claims, 5 Drawing Figures

METHOD FOR THE PRODUCTION OF A VENEER

The present invention relates to a method for the production of a veneer resistant to micro-organisms, insects and other harmful products which is suitable for use in constructions for joinery, construction, packaging and installation applications.

The invention also relates to a method for the production of wood veneer of the nature indicated, which contains a colour pigment and a fire-retardant medium.

The principal object of the present invention is primarily to make available a method of the nature indicated above which will solve the problem of achieving the simple and effective penetration of the particular impregnation medium concerned or some other medium into the wood veneer with no use of mechanical pressure, and without the risk of causing damage to the wood, as is the case with conventional pressure-impregnation, in which up to 600 liters of impregnation liquid/$m^3$ sapwood are forced into the wood material over a short period and at high pressure. This previously disclosed method of impregnation destroys the cell membranes, for which reason the wood material, once it has dried, will absorb more water, resulting in greater dimensional changes and the creation of conditions suitable for the onset of rot. Furthermore, only the sapwood of the pine can be impregnated, with the heartwood and the whitewood remaining largely unimpregnated. Moreover, the large quantity of impregnation solution used takes about 6 months to air-dry.

The aforementioned object is achieved by the method in accordance with the present invention.

The invention is described below as a number of preferred illustrative embodiments, in conjunction with which reference is made to the drawings, in which:

FIG. 1A illustrates in diagrammatic form the path of a first impregnation plant or similar;

Figure 1A:
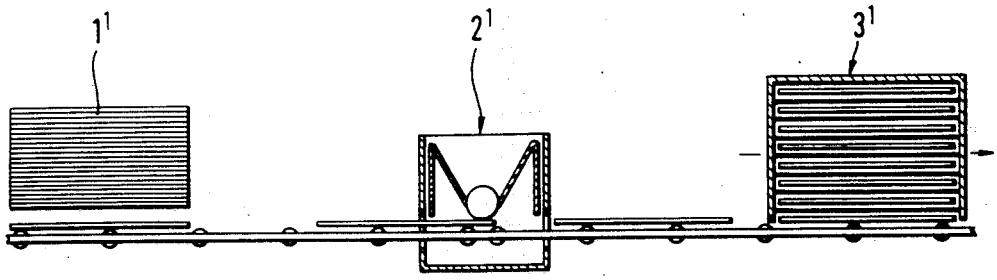

In accordance with the present invention wood veneer $1^1$, $1^2$, $1^3$ which is cut or sliced from softwood or hardwood timber, such as pine, spruce or birch, is impregnated before an excessively long period has elapsed from the time of cutting or slicing, so that the high moisture content exhibited by the wooden raw material can be utilized in conjunction with the processing period in order to increase the penetration capacity of the impregnation medium. The ring pore membranes of the moist, steamed timber are thus open for a short time after the aforementioned processing period, thereby enabling the impregnation medium in question to be diffused by so-called chemical osmotic overpressure through the open ring pores and into the whole of the raw timber, that is to say all the way into the heartwood of the veneer $1^1$, $1^2$, $1^3$, without having to be forced, as in the case of the pressure vacuum process, in order to achieve complete penetration.

By the application to the surface of the veneer of a concentrated solution of, for example, an impregnation salt, a colour pigment or a fire-retardant medium, active constituents of the solution are able to diffuse into the internal moisture of the wood veneer, which thus acts as a carrier. The impregnation medium may contain water-soluble salts of copper, chromium and arsenic which, by reacting with the timber, form sparingly soluble preservative substances, or may contain sparsely soluble metal salts with a preservative effect which are rendered water-soluble with the help of solvents—for example ammonia compounds—which, after evaporation, leave behind a residue of the sparingly soluble protective metal salts in the timber.

After the diffusion process, which proceeds rapidly depending on the thickness of the veneer or the kind of wood, the veneer is dried, in conjunction with which the solution water evaporates, the impregnation salts and/or the colour pigment or fire-retardant medium are fixed to the cell walls, and the undamaged ring pores are closed after being heated and when the chemically reaction of the salts being facilitated. The thickness of the veneer and the direction of the fibres are determined by the elasticity and strength of the wooden raw material, the winding radiuses and the load curves for the construction. The width of the strip of veneer is determined by the winding profile. Normal veneer thickness is from approximately 1 to 5 mm.

The veneer is now ready to be glued together to form a laminate, in which both dimensions and form, fibre directions and any reinforcement can be optimized for each particular construction.

This impregnation method is uniquely gentle on the timber by comparison with the pressure impregnation method. On the one hand the ring pores of the cells are naturally open in conjunction with cutting, and on the other hand no fluid is ever forced into the timber, and finally it is only the nature moisture of the timber which requires to be dried out. The timber and the cell membranes are never damaged by this gentle method, for which reason the finished wooden material will not only absorb less water and will accordingly be less prone to rotting, but will also lack a tendency to cracking and other deformation by comparison with pressure-impregnated timber.

Impregnation can take place by the immersion of the wood veneer in vessels containing a solution of the impregnation medium, or by spraying through nozzles. Impregnation can take place in accordance with what is illustrated in FIG. 1 by causing the veneer to pass through a roller applicator $2^1$, $2^2$, in which the design of the roller is able to control precisely the quantity of the solution which it is wished to apply. The necessary quantity of the fixed impregnation medium will then be a product of the quantity of solution applied and the concentration of the solution. The rollers may be provided with channels, for example, with a superjacent, parallel roller not only spreading but also regulating the quantity of solution over the main roller. The main roller can also be provided with grooves and can be imparted with a certain softness for the purpose of controlling the quantity applied, as illustrated in FIG. 1C.

The method permits the use of existing commercially available impregnation solutions. Examples of such water-based solutions are copper, chromium and arsenic salts. These are fixed as a consequence of the reactions which occur when the chromium (the chromic acid) is reduced by the timber substance from a negative hexavalent to a positive trivalent ion. The use is also possible of agents dissolved in ammonia and ammonia salts containing, for example, a copper compound and some other component such as arsenic acid, boric acid and/or caprylic acid. The agent is fixed when the solvent of the ammonium compound evaporates.

Preservation using oil or oil-soluble agents is not as suitable in view of the subsequent glueing operation. Impregnation is, however, possible using emulsions in water of oil-soluble active agents.

The result of the impregnation process will depend to a certain extent on the thickness of the veneer and on the type of wood used. In the case of thin veneer penetration will take place more rapidly, and drying and fixing can also take place more rapidly.

In view of the high moisture content of the veneer, it will be necessary as a rule for the solution applied to be at a high concentration. This is especially true if the venner is thick.

The ammoniacal solutions penetrate more rapidly than the acidic solutions containing chromic acid, and are to be preferred as a general rule. When working with thin veneers, the opportunity exists by the supply of heat to perform the impregnation continuously immediately or in conjunction with glueing.

With regard to the processing of hardwood timber, it should be noted that this requires a certain period to elapse before the impregnation agents penetrate through the cell wall. Once the preservative solution has been applied, it will be necessary in this case to wait before drying the veneer for a sufficient period to allow the agents to diffuse into the timber. Rapid-fixing agents should not, therefore, be present in hardwood laminates, which cannot normally be impregnated to good effect, but which are impregnated by applying slow-fixing agents—for example agents in ammoniacal solution—and by then keeping the timber moist with the preservative agents dissolved for a sufficient time for the agents not only to penetrate into the timber, but also to pass through the cell walls of the hardwood.

FIG. 1A illustrates in diagrammatic form a method whereby raw sheets of veneer $1^1$ are fed through an impregnation plant $2^1$, whereupon they are dried in a stack drier $3^1$.

Figure 1B:
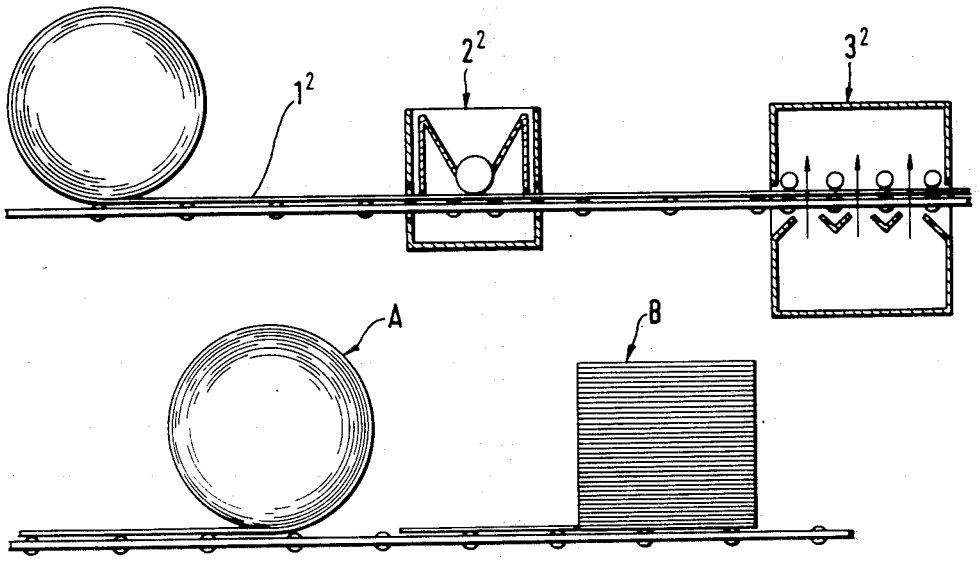
FIG. 1B illustrates in diagrammatic form the path of a second plant.
Figure 1C:
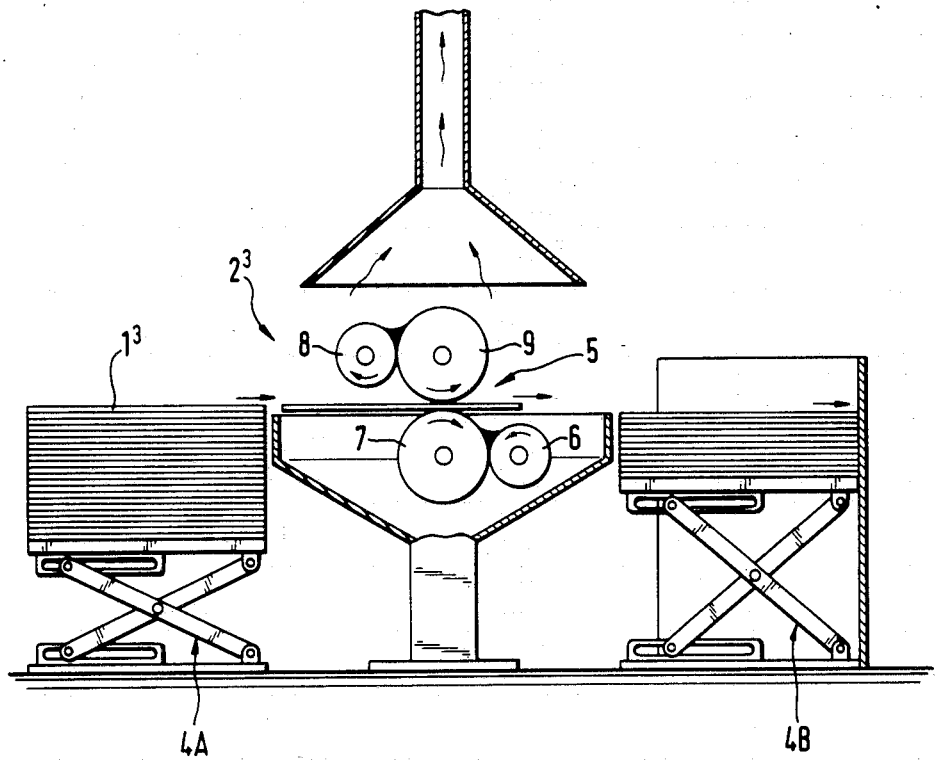
FIG. 1C illustrates in diagrammatic form the path of a third plant.

FIG. 1B illustrates in diagrammatic form a method whereby veneer $1^2$ which has been cut or sliced from a log is fed continuously through an impregnation plant $2^2$ for continuous drying in a veneer drier $3^2$ prior to being wound into a roll A or cut into sheets B.

Illustrated in FIG. 1C is a method whereby veneer $1^3$ is fed from a scissor-lift table 4A and through the roller applicator $2^3$, where a precise quantity of a specified solution concentration is applied. The impregnated veneers are arranged immediately in stacks on the scissor-lift table 4B and are transported by industrial truck to the drying oven.

The impregnation liquid is pumped directly from the vessel in which it is supplied or from a bulk tank to the applicator system 5. The rate of application is regulated by means of the double rollers 6, 7, 8, 9 releasing varying quantities of the liquid depending on how hard they are forced into contact one against the other. The applicator roller 7, 9 may be grooved for this purpose, or may be soft and porous.

After drying, the veneer 1 is glued together to form a laminate 10. It is possible in this way to optimize both the direction of the fibres and the dimension and form and any composite materials, as well as the reinforcement 11 and surface coatings for each particular construction. So-called resorcinol glue may be a suitable adhesive, for example.

The finished wood laminate can be used in a number of areas where wood is naturally used or where wood is replaced by other materials, such as steel, plastic and aluminium in view of its proneness to rotting.

For extreme loads, reinforcement in the form of textile, synthetic or mineral fibre/netting can be positioned between the various layers of veneer or at the surface of the constructions.

The surfaces of the constructions can also be finished with fine timbers or with other decorative material. In addition to impregnation with colour pigments, the outside of the finished construction can also be coloured by immersion, spraying or other processes, or can be provided with print and other patterns.

The surfaces of the constructions can also be given increased solution characteristics with regard both to heat and to electricity or fire or hydrological and atmospheric permeability.

The manufacture of tubes can take place in a number of different ways. The tubes can be used or many purposes, such as posts, masts, beams, pipelines or containers.

Figure 2:
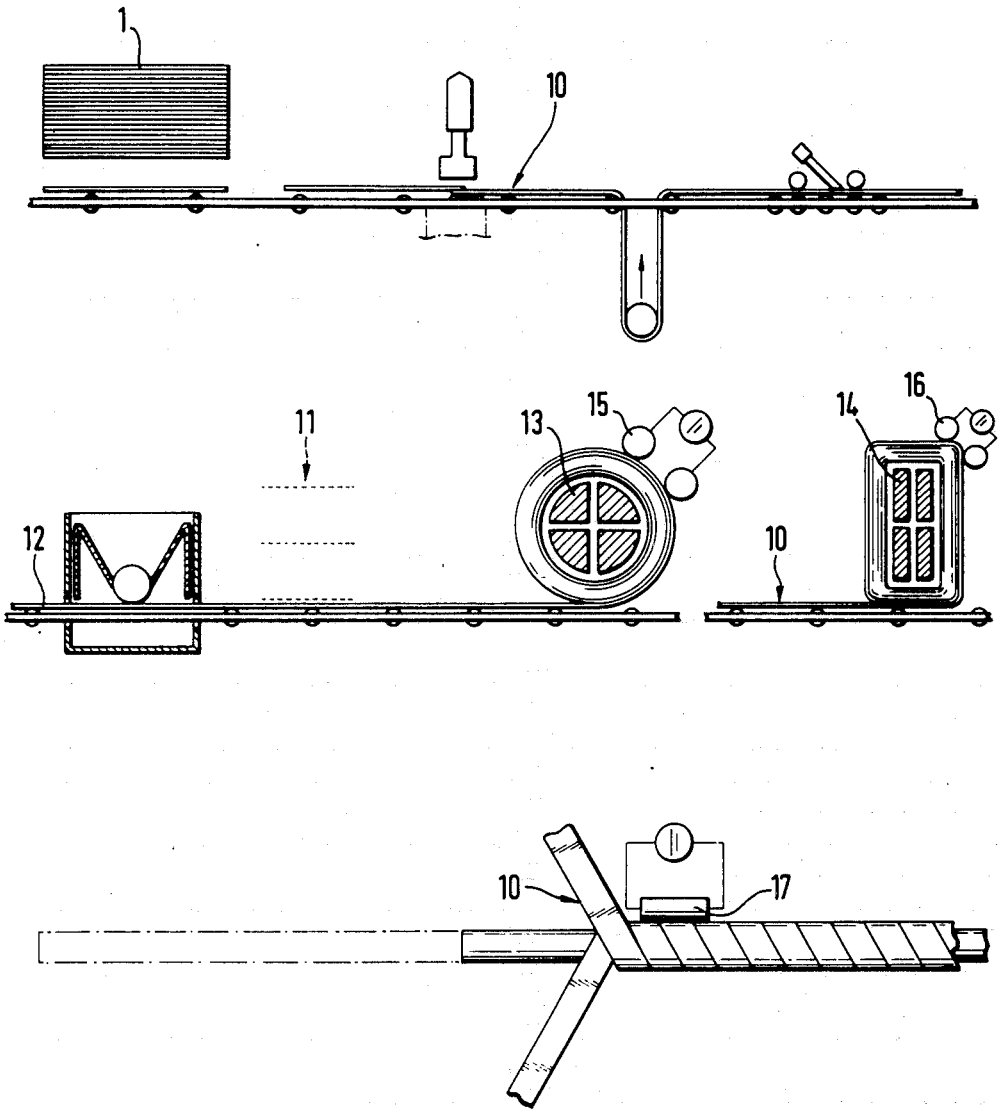
FIG. 2 illustrates a plant for the manufacture of wound structures made from the produced impregnated wood laminate.

One rational embodiment is, as shown in FIG. 2, for veneer 1 to be joined after impregnation into a continuous strip. This longitudinal splicing can also take place in conjunction with the laying-up of the laminate. The continuous strip 12 has adhesive applied to it and is then rolled under maximum extension and control around, for example, a vacuum drum 13, 14 of the desired form. The construction can be hardened either fully or in part in thin lines by means of a high-frequency roller press 15, 16, 17 in contact with it, in conjunction with which the strip 10 is fed in, or after the complete laminate has been laid-up.

Figure 3:
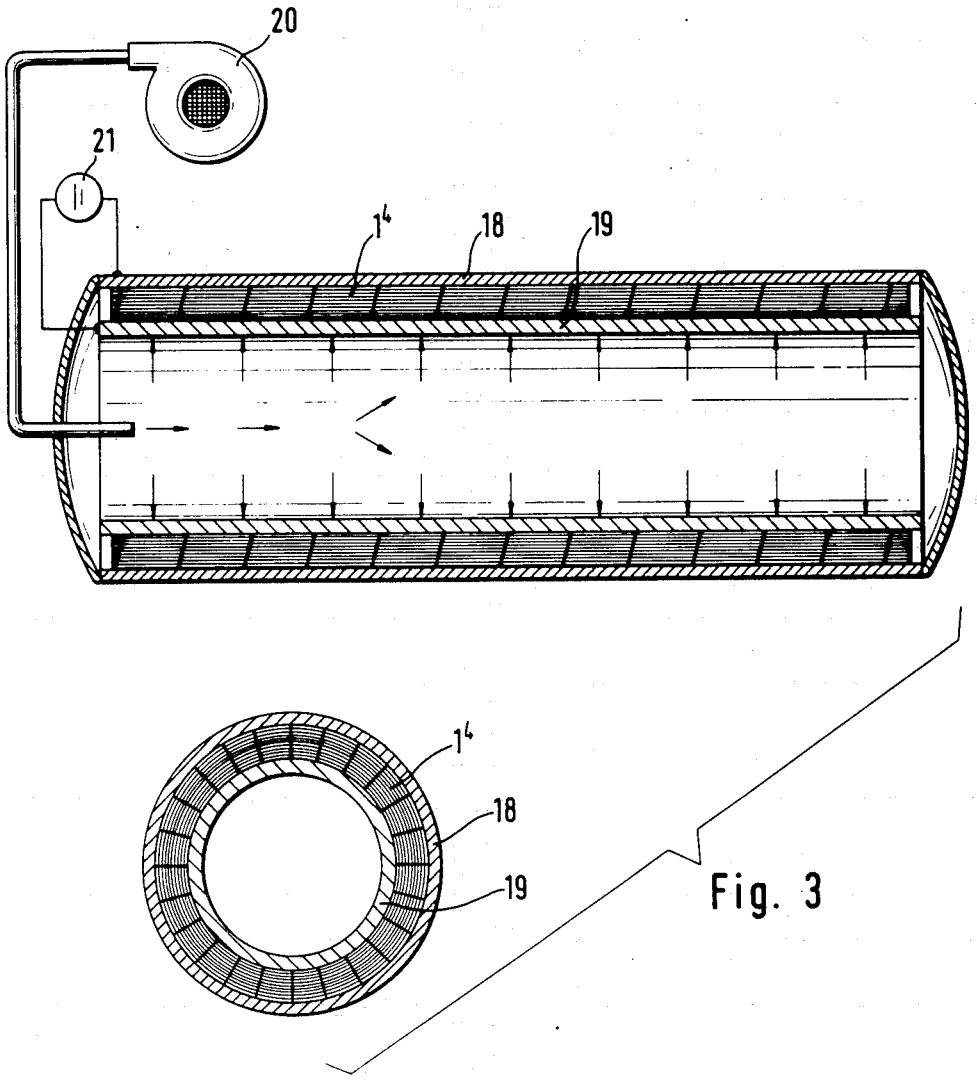
FIG. 3 illustrates a hardening plant for wound structures.

It is also possible, as shown in FIG. 3, for the laminate to be transported in an unhardened state into an adjacent metal cylinder 18, where it can harden under pressure (mechanical or atmospheric) and heat (long-wave or short-wave, so-called high-frequency). The construction is then ready for further manufacture and use. The dimensions of the tube may vary. Thus, posts may be produced with diameters from 0.1 to 1.0 m, with corresponding material thicknesses from 0.01 to 0.1 m, and with lengths from 1.0 to 50 m, for example. No other method permits such flexibility and such a wide range of applications for the product.

As illustrated in FIG. 3, the unhardened construction $1^4$ can be introduced on a drum 19 into a cylinder 18, the internal form of which corresponds to the finished external form of the construction. The cylinder can, of course, be introduced over the drum as an alternative. By the application of mechanical pressure between the drum 19 and the cylinder 18, or by the creation of an increasing atmospheric positive pressure inside the cylinder from a compressor 20, the construction $1^4$ is forced against the cylinder wall. By exposure to ordinary long-wave heat or to short-wave, high-frequency heat 21, the construction is hardened and is then ready for further manufacture or use.

The construction $1^4$ can also be introduced into the cylinder 18, but dispensing with the drum. If high-frequency heating is used, the drum 19 is replaced by a new core to act as a pole.

Another possible production method may be for longitudinally-spliced veneers to be laid-up as a flat, long and narrow laminate, which is then pressed into the form of a semi-cylinder. Two semi-cylinders are then glued together by means of longitudinal finger splices to produce a complete cylinder, that is to say a tubular post. The latter method allows only a single direction of pressing to be used, but with two different pressing operations, with finger milling and adhesive application/assembly taking place between the pressing operations.

A further field of application is by making standard plywood.

I claim:

1. A method for the production of a veneer resistant to micro-organisms, insects and other harmful products, which is suitable for use in constructions intended for joinery, construction, packaging, and installation applications, the method comprising impregnating a wood veneer which is cut or sliced from a piece of timber, with a concentrated solution of an impregnation salt or other impregnation medium by applying the impregnation salt or other impregnation medium to the surface of the veneer while the veneer is still moist, under no mechanical pressure and before the ring pores thereof have become sealed, so that a controlled quantity of the solution of the impregnation salt or other impregnation medium is distributed in the veneer by chemical osmotic overpressure diffusion through the cell walls thereof, and drying the impregnated veneer by heating the veneer so that the ring pores of the cell walls thereof are sealed.

2. The method according to claim 1, wherein the veneer is dried until its moisture content is less than 10%.

3. The method according to claim 1, further comprising using an impregnation salt or other impregnation medium which contains preservative and sparingly soluble metal salts which have been made water-soluble by means of ammonia compounds or other solvents which, after being driven off by heating, leave behind a residue of the sparingly soluble protective metal salts in the veneer.

4. The method according to claim 1, wherein water-based solutions of copper, chromium and arsenic salts are used as the impregnation salt or other impregnation medium.

5. The method according to claim 1, wherein the solution of impregnation salt or other impregnation medium is applied to the veneer by immersion of the veneer in a vessel filled with the impregnation solution.

6. The method according to claim 1, wherein the solution of impregnation salt or other impregnation medium is applied to the veneer by spraying through a number of nozzles.

7. The method according to claim 1, wherein the solution of the impregnation salt or other impregnation medium is applied to the veneer in conjunction with the veneer passing through a roller applicator, in which the design of the roller applicator controls the quantity of the solution of the impregnation salt or other impregnation medium applied to the veneer.

8. The method according to claim 1, wherein the veneer, after absorbing the impregnation solution, is dried in a heating oven.

9. The method according to claim 1, wherein the veneer, after absorbing the impregnation solution, is dried by continuous drying, when the veneer in the form of a long strip is transported through a drier provided with heat.

10. The method according to claim 1, wherein the veneer is dried by the supply of steam.

11. A method for the production of a veneer impregnated with a color pigment or a fire-resistant medium which is suitable for use in constructions intended for joinery, construction, packaging, and installation applications, the method comprising coating a wood veneer, which is cut or sliced from a piece of timber, with a concentrated solution of an impregnation color pigment or fire-retardant medium while the veneer is still moist and before the ring pores thereof have become sealed with the color pigment or fire-retardant medium, so that the impregnation solution is distributed by chemical osmotic overpressure diffusion in the veneer through the cell walls thereof, and drying the impregnated veneer by heating the same, so that the ring pores of the cell walls thereof are sealed.

* * * * *